United States Patent [19]

Daswick

[11] 3,999,799

[45] Dec. 28, 1976

[54] ADJUSTABLE RECLINING CHAIR, AND METHOD

[76] Inventor: Alexander C. Daswick, 647 Orange Grove, South Pasadena, Calif. 91030

[22] Filed: May 23, 1975

[21] Appl. No.: 580,482

Related U.S. Application Data

[63] Continuation-in-part of Ser. No. 450,069, March 11, 1974, abandoned.

[52] U.S. Cl. ..... 297/270; 297/325; 297/330

[51] Int. Cl.[2] ..... A47C 3/02

[58] Field of Search ..... 297/258, 261, 262, 270, 297/310, 325–330

[56] References Cited

UNITED STATES PATENTS

| | | | |
|---|---|---|---|
| 153,478 | 7/1874 | Cutter | 297/328 |
| 702,331 | 6/1902 | Roberts | 297/270 X |
| 1,438,667 | 12/1922 | Schöps | 297/329 |
| 1,555,689 | 9/1925 | Miller | 297/262 |
| 2,541,612 | 2/1951 | Ricketson | 297/2 |
| 3,227,488 | 1/1966 | Kosbab et al. | 297/330 |
| 3,232,574 | 1/1966 | Ferro | 297/329 X |
| 3,232,575 | 1/1966 | Ferro | 297/329 X |
| 3,235,304 | 2/1966 | Glass | 297/327 X |

*Primary Examiner*—James C. Mitchell
*Attorney, Agent, or Firm*—Gene W. Arant

[57] ABSTRACT

An adjustable reclining chair includes a seat and back supporting frame having a pair of rocker or rocker-shaped members. The rocking action of the rocker members is, however, restrained by a restraint mechanism. A drive mechanism is utilized to move the restraint mechanism, in either a forward or a rearward direction, to adjust the angle at which the chair reclines.

52 Claims, 15 Drawing Figures

FIG. 3.
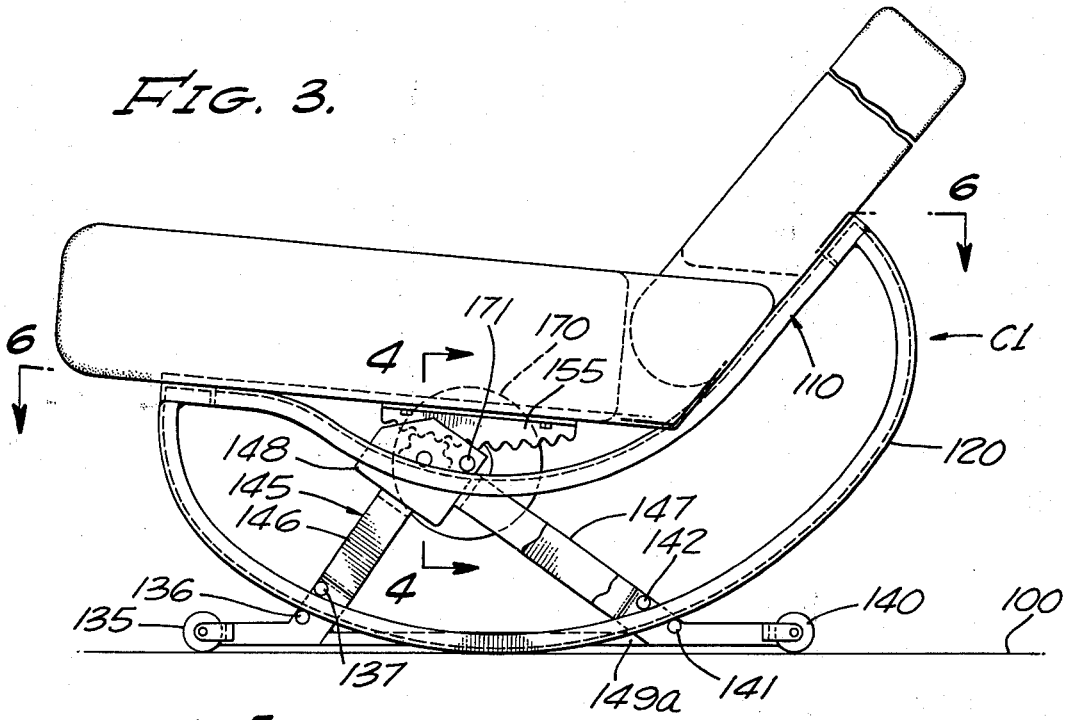
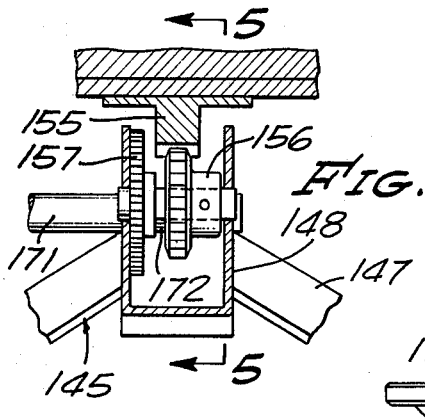
FIG. 4.
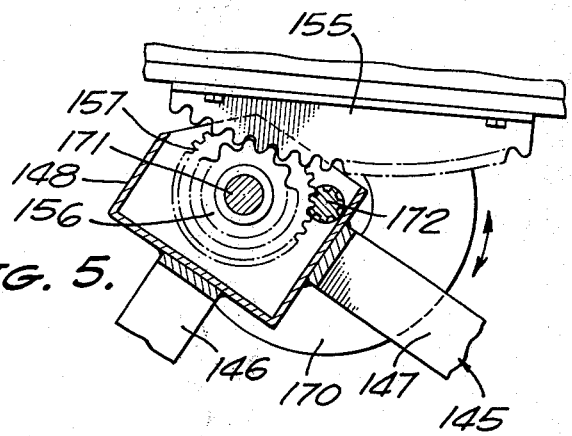
FIG. 5.
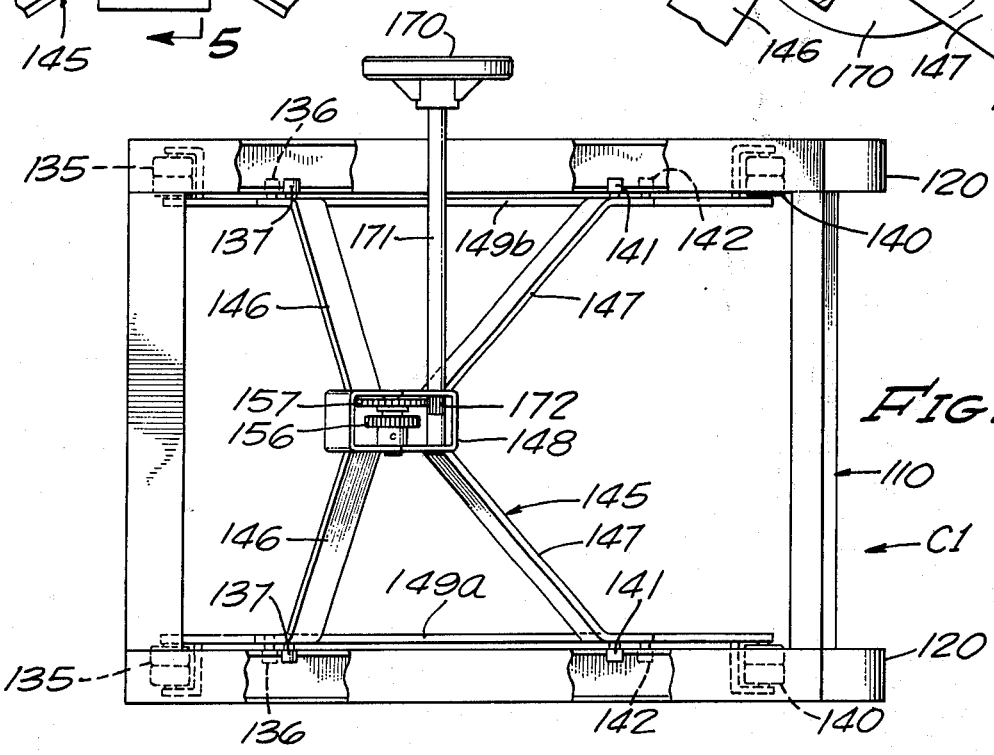
FIG. 6.

FIG. 13.
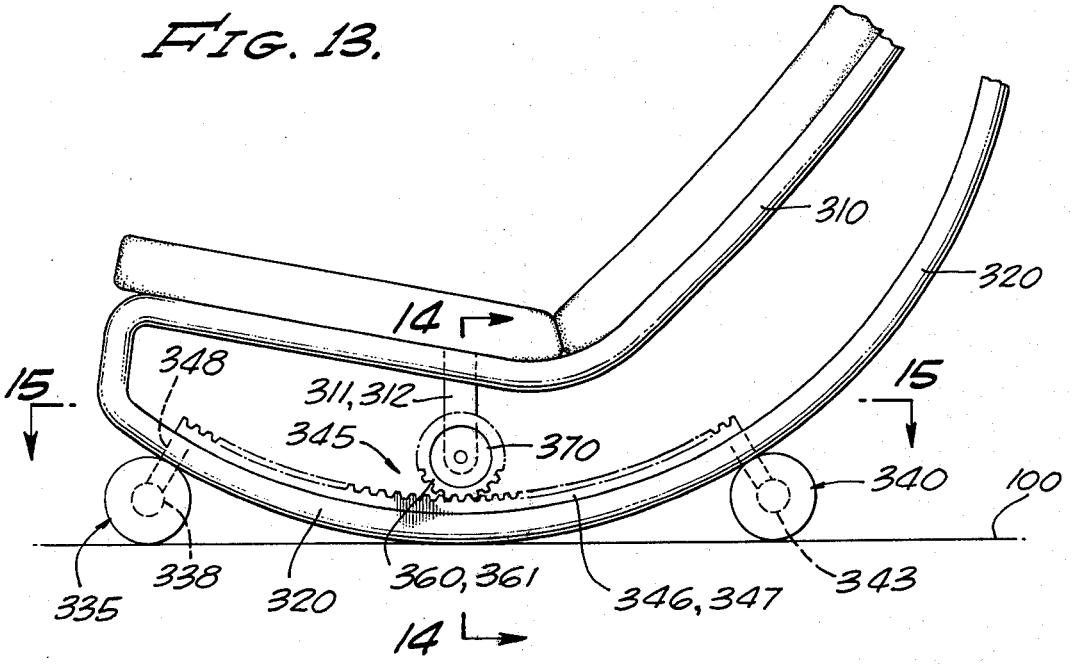
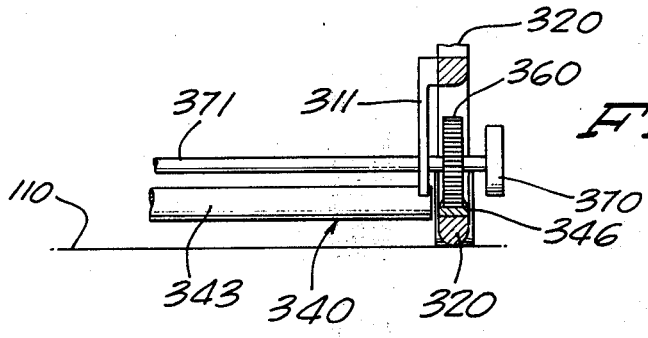
FIG. 14.
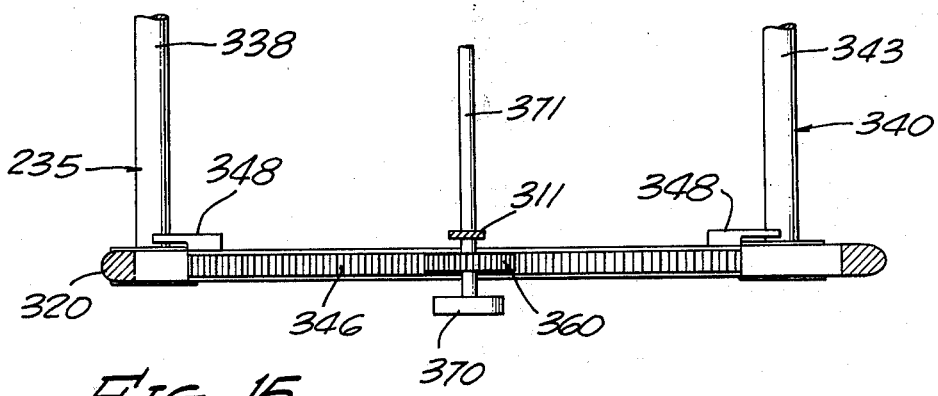
FIG. 15.

ADJUSTABLE RECLINING CHAIR, AND METHOD

RELATED APPLICATION

This application is a continuation-in-part of my prior copending application Ser. No. 450,069 filed Mar. 11, 1974 and subsequently abandoned.

BACKGROUND OF THE INVENTION

Older persons find the use of a reclining chair to be very desirable and perhaps even necessary. It is also desirable to have a convenient mechanism by which the user of the chair may manually adjust the angle at which it reclines.

Adjustable reclining chairs which have heretofore been available have, however, included complex mechanism which is expensive to manufacture. It would be desirable to achieve the position adjustment with a simpler and less expensive mechanism.

The object and purpose of the present invention, therefore, is to provide an adjustable reclining chair whose position adjustment mechanism is simple in construction, easy to operate, and inexpensive to manufacture.

SUMMARY OF THE INVENTION

According to the present invention an adjustable reclining chair is provided by utilizing a traditional rocking chair in a novel manner. A restraint mechanism engages both the floor surface and the chair frame so as to effectively restrain the normal rocking action. The restraint mechanism is movable either forwardly or rearwardly relative to the chair frame. When the restraint mechanism is moved forwardly relative to the rocker members the back end of the chair is raised up and the front end drops down, so that the chair is in a more nearly upright position. When the restraint mechanism is moved rearwardly relative to the rocker members the front end of the chair is raised upward and the rear end drops down, with the result that the chair leans back even further than before.

In one form of the invention the restraint mechanism includes front and rear chucks which not only engage the floor surface but also engage the under surfaces of the rocker members so as to directly inhibit their movement.

In another form of the invention a restraint frame has one part movably secured to the chair frame and another part engaging the floor surface at a location longitudinally displaced from the engagement thereof by the rockers. The restraint frame carries some of the weight load from the chair frame. A drive mechanism is utilized to change the angular position of the restraint frame, and hence the angle at which the chair frame reclines.

The invention also provides a novel method of using a rocking chair as an adjustable reclining chair.

DRAWING SUMMARY

FIG. 3 is a side elevation view of the chair of FIG. 2;

FIG. 4 is a fragmentary view taken on line 4—4 of FIG. 3;

FIG. 5 is a cross-sectional view taken on line 5—5 of FIG. 4;

FIG. 6 is a cross-sectional view taken on line 6—6 of FIG. 3;

FIG. 13 is a side elevation view of a third embodiment of the invention;

FIG. 14 is a cross-sectional view taken on line 14—14 of FIG. 13; and

FIG. 15 is a cross-sectional view taken on line 15—15 of FIG. 13.

GENERAL FORM — FIG. 1

Figure 1:
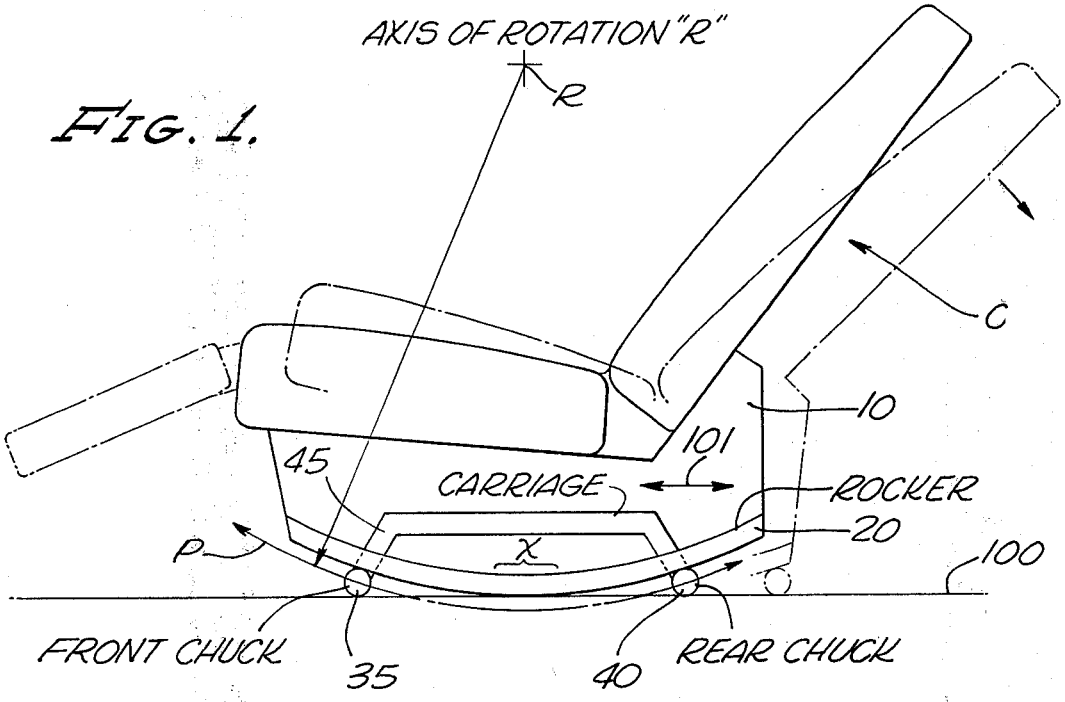
FIG. 1 is a schematic diagram of the invention showing its mode of operation.
Figure 2:
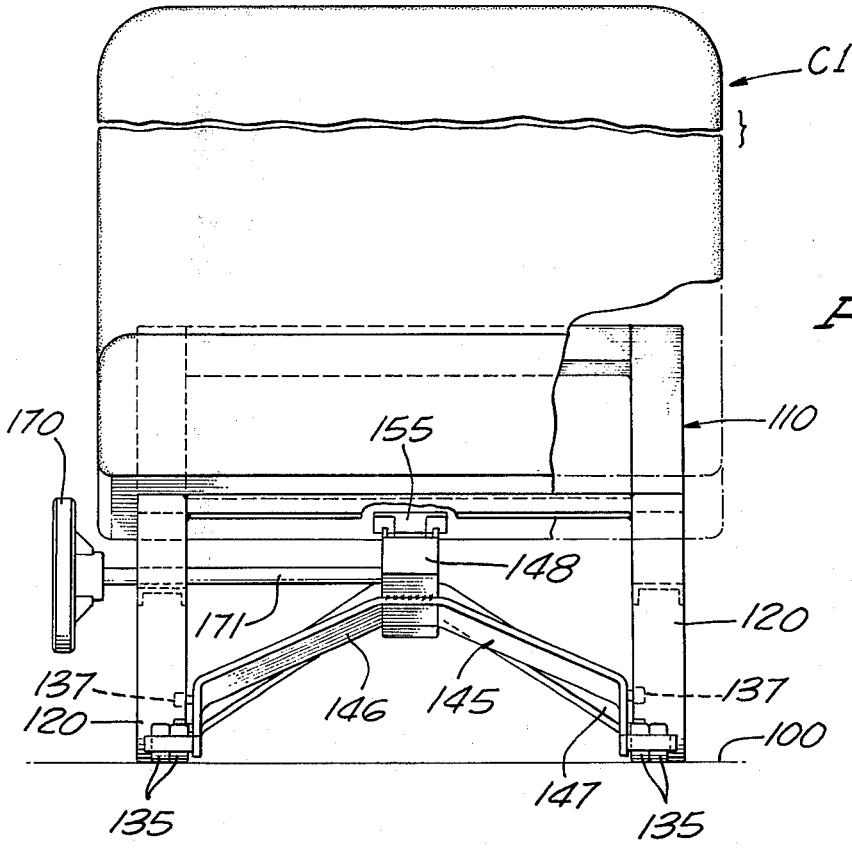
FIG. 2 is a front elevation view of a first embodiment of the invention.

As shown in FIG. 1 the chair C includes a seat and back supporting frame 10 including and supported from a pair of rocker or rocker-shaped members 20. The rocker members engage the surface of a floor 100 along a relatively small selected longitudinal portion X of their length.

Any rocking movement of the rocking members is inhibited by a front chuck 35 and a rear chuck 40. The front chuck 35 is disposed in front of the floor engaging portion X of the rockers and engages both the upper surface of the floor 100 and the under-surfaces of the rockers 20. Rear chuck 30 is disposed to the rear of the floor engaging portion X of the rocker members and rests upon the floor surface 100 and also engages the under-surfaces of the rocker members. A carriage 45 is attached to both the front chuck 35 and the rear chuck 40 and permits them to be moved either forwardly or rearwardly as a unit.

In the simplified embodiment of the invention as shown in FIG. 1 the entire restraint mechanism may consist of a single tubular frame. The frame is rectangular with the corners being slightly truncated so that there are four relatively long sides and four relatively short sides. Two opposing ends of the frame are bent upwardly at an angle relative to the intermediate portion. The intermediate portions of the frame then rest upon the floor where they provide front chuck 35 and rear chuck 40, while the upwardly bent ends provide an indentical pair of carriages 45. Either carriage may be grasped by hand for the purpose of sliding the restraint mechanism, as a unit, in either a forwardly or rearwardly direction relative to the rocker members 20.

Thus the restraint mechanism slides horizontally along the floor in either a forwardly or rearwardly direction, as indicated by the double-headed arrow 101. But there are also other ways to explain the movements of the restraint mechanism.

It is necessary that the restraint mechanism move along a curved pathway relative to the rocker-shaped members. As the restraint mechanism moves, the rocker members progressively tilt, and the resulting movement of the restraint mechanism is precisely horizontal as shown by arrow 101.

The rocker members may, for example, be of such configuration that their undersurfaces fall on the arc of a circle. This is the configuration shown for rocker members 20 in FIG. 1. The center of the circle is then a horizontal axis of rotation R which is located some distance above the chair and extends in a direction perpendicular to the planes of the rocker members. With this mathematically symmetrical configuration of the rocker members the movement path P of the restraint mechanism also falls on the arc of a second circle that is concentric to the first circle.

When the restraint mechanism is moved forwardly the rearward end of the chair is raised up and the front end drops down with the result that the chair assumes a more upright position. When the restraint mechanism is moved rearwardly the opposite action takes place.

The restraint mechanism illustrated in FIG. 1 cannot conveniently be moved by a person while he is occupying the reclining chair. Therefore, in accordance with the present invention it is preferred to utilize a gear drive mechanism, equipped with means for manually controlling its operation, in order to move the restraint mechanism through its curved pathway relative to the chair frame or rocker members.

FIRST EMBODIMENT

Reference is made to FIGS. 2 through 7, inclusive, illustrating a first embodiment of the invention.

The chair C1 includes a frame 110 which includes and is supported by a pair of curved rocker members 120. Each rocker member is a channel-shaped metal member with its ends curved upward and welded to the respective ends of the frame 110.

The restraint frame 145 includes several separate pieces that are welded together. A forward strap 146 includes parallel end pieces adjoining a mid portion which bends both upwardly (FIG. 3) and inwardly (FIG. 6). A rear strap 147 is similarly shaped. The upper ends of both straps 146, 147 are welded to a gear box 148. Side pieces 149*a*, 149*b* (FIG. 6) are welded between the lower portions of the two straps 146, 147 to provide a pair of continuous lower side portions of the frame 145.

Rollers 135 are mounted on each of the forward ends of the strap 146 and engage the floor surface 100. Each side portion of strap 146 also carries a lower roller 136 and an upper roller 137. Lower roller 136 engages the flat undersurface of the associated rocker member 120. Upper roller 137 rolls along the upper surface of the outer edge wall of the rocker member.

In similar fashion rollers 140 are attached to the rearward ends of the rear strap 147. Each side of the strap 147 carries a pair of rollers 141, 142. Roller 141 engages the under flat surface of the rocker 120 while roller 142 engages the upper edge of the outer wall of the rocker member.

Figure 7:
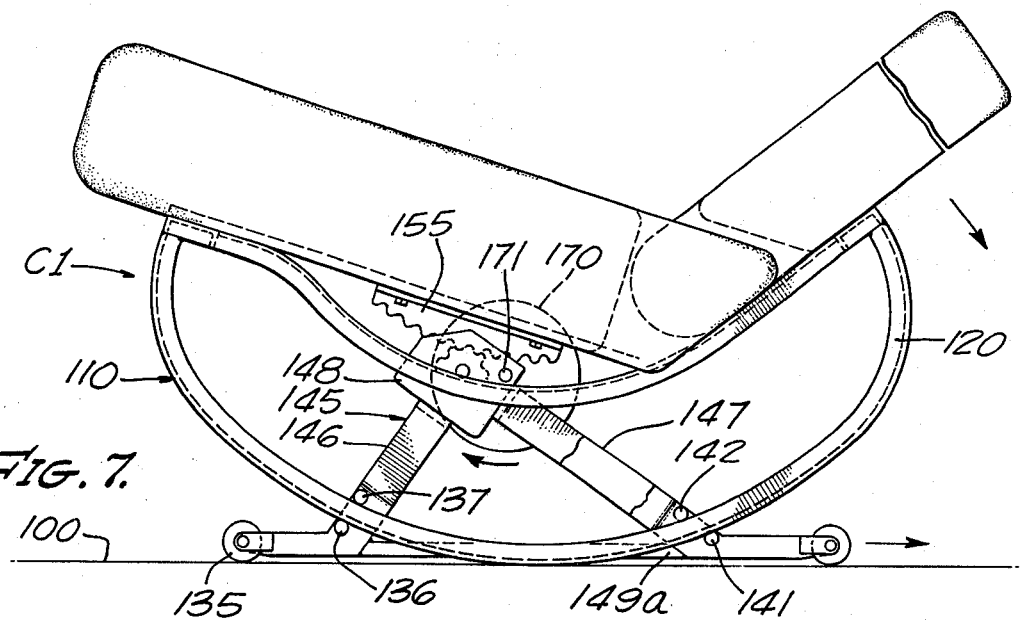
FIG. 7 is a side view like FIG. 3, but showing the chair in a different position.
Figure 8:
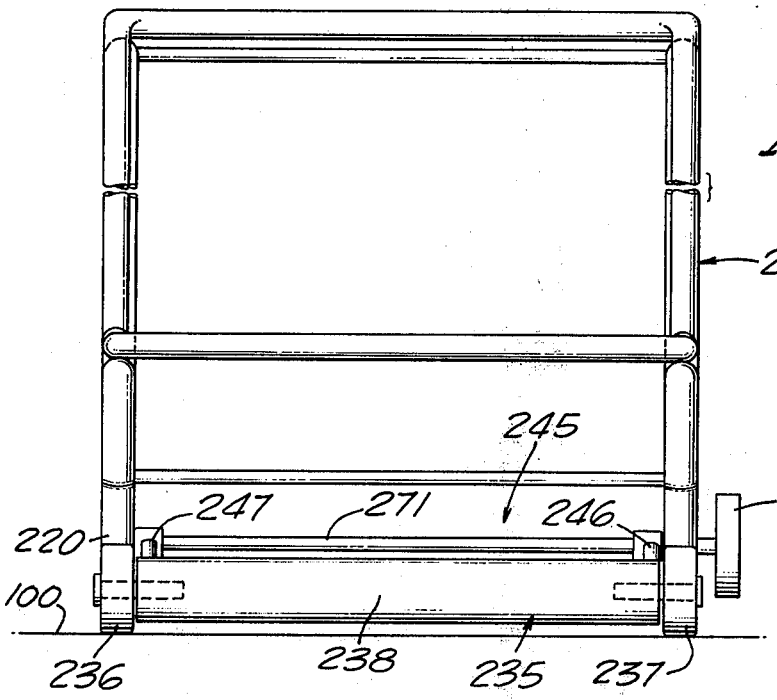
FIG. 8 is a front elevation view of a second embodiment of the invention.
Figure 9:
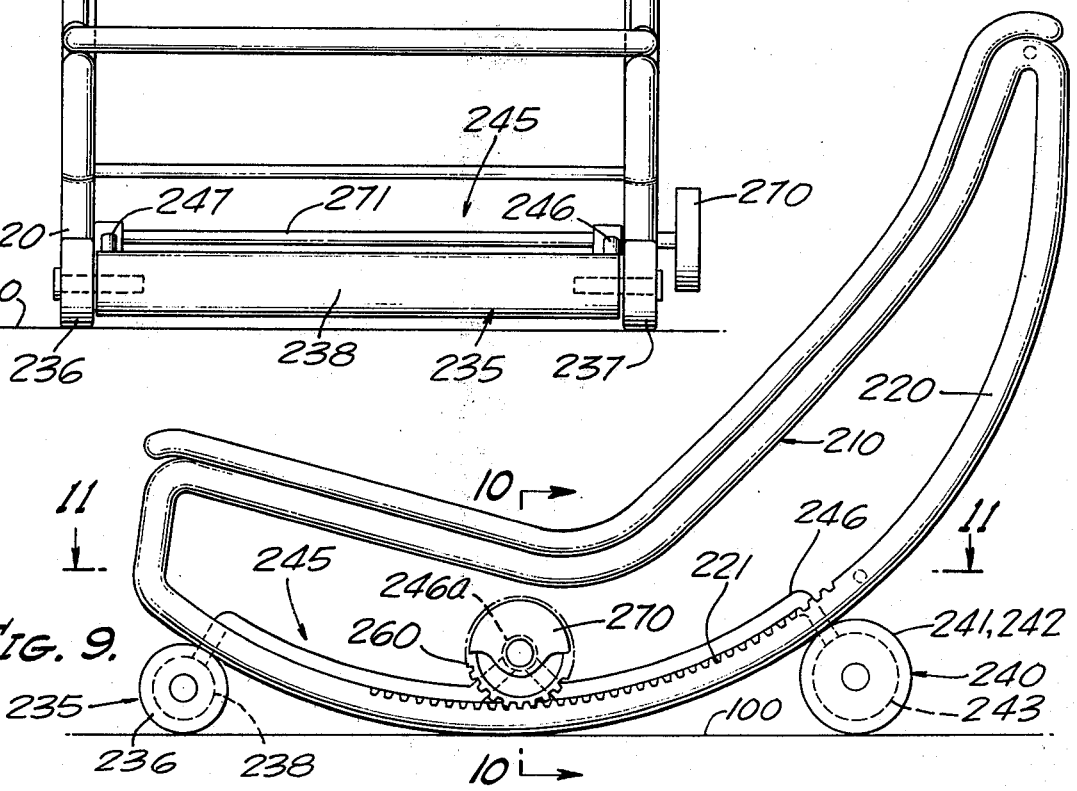
FIG. 9 is a side elevation view of the chair of FIG. 8.
Figure 10:
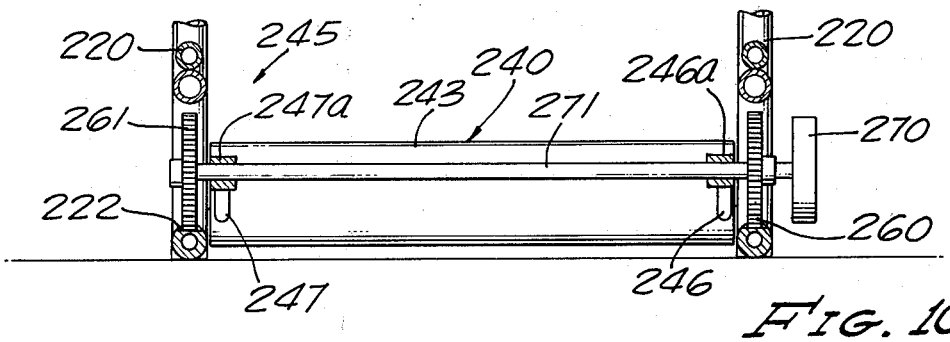
FIG. 10 is a cross-sectional view taken on line 10—10 of FIG. 9.
Figure 11:
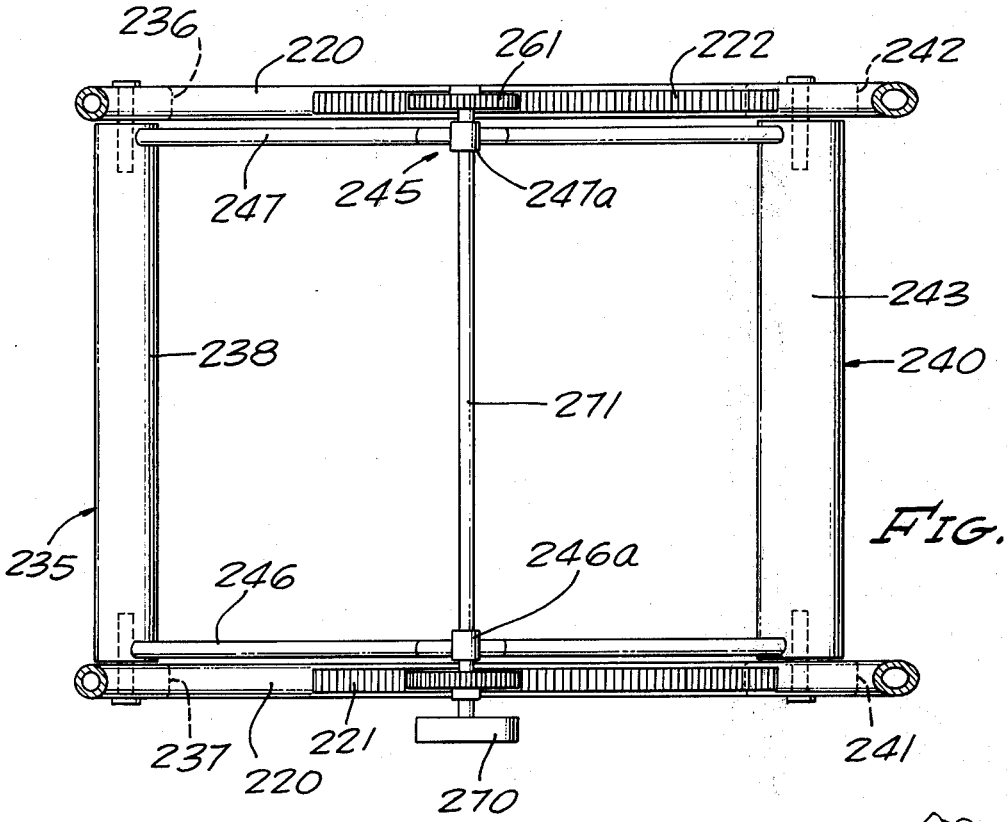
FIG. 11 is a cross-sectional view taken on line 11—11 of FIG. 9.

In the embodiment of FIGS. 2 through 7, inclusive, the position of the chair is adjusted by means of a hand wheel 170 which in turn drives a gear mechanism. A convexly curved toothed rack 155 is attached to the underside of frame 110. A drive gear 156 and a spur gear 157 are located inside the gear box 148 and mounted on a common shaft 173. Drive gear 156 engages the toothed rack 155. Hand wheel 170 is attached to the outer end of a shaft 171 whose inner end projects through both lateral walls of the gear box 148 and is rotatably mounted therein. A pinion gear 172 is formed on the end of shaft 171 within the gear box 148. The pinion gear engages spur gear 157. Therefore, rotation of the hand wheel 170 causes drive gear 156 to ride either forwardly or rearwardly on the curved gear rack 155, thus driving the restraint mechanism in a curved pathway relative to the chair frame 110. FIG. 3 shows the chair in a relatively upright position. FIG. 7 shows the chair in a relatively reclined position. As shown by arrows in FIG. 7, when the underside of hand wheel 170 is moved forward the entire restraint mechanism is driven rearwardly which causes the chair to recline more sharply than before.

In the embodiment of FIGS. 2 through 7 the rollers 136, 141 and the gear 156 together receive a significant portion of the weight load on the chair frame and transmit it to rollers 135, 140. The turning movement of the restraint frame 145, 147 relative to the chair frame drives the rollers 135, 140 along the floor surface and thereby changes the angle at which the chair frame reclines.

SECOND EMBODIMENT

Reference is now made to FIGS. 8 through 12, inclusive, illustrating a second embodiment of the invention.

The chair frame 210 includes and is supported from a pair of rocker members 220. A front chuck 235 includes a pair of wheels 236, 237 (FIG. 8) which are rotatably supported on the ends of an axle 238. In similar fashion a rear chuck 240 includes wheels 241, 242 which are rotatably supported on the ends of an axle 243. Chuck carriage 245 includes side frames 246, 247. Side frame 246 extends between and is attached to the axles 238, 243 on one side of the chair, while side frame 247 extends between and is attached to the same axles on the other side of the chair. Each side frame 246, 247 is located inside its associated rocker member 220.

Side frame 246 has an apex portion 246*a*, and side frame 247 has an apex portion 247*a*. A shaft 271 is rotatably mounted in the apex portions 246*a* and 247*a*. Shaft 271 protrudes from one side of the chair (FIG. 11) where a hand wheel 270 is attached to its end.

On one side of the chair the upper surface of rocker member 220 is notched to provide a concave toothed rack 221, while on the other side of the chair the rocker member 220 is notched to provide a similar concave toothed rack 222. Drive gears 260, 261 are rigidly supported on corresponding ends of the shaft 271. Drive gear 260 engages the toothed rack 221 while drive gear 261 engages the toothed rack 222.

Figure 12:
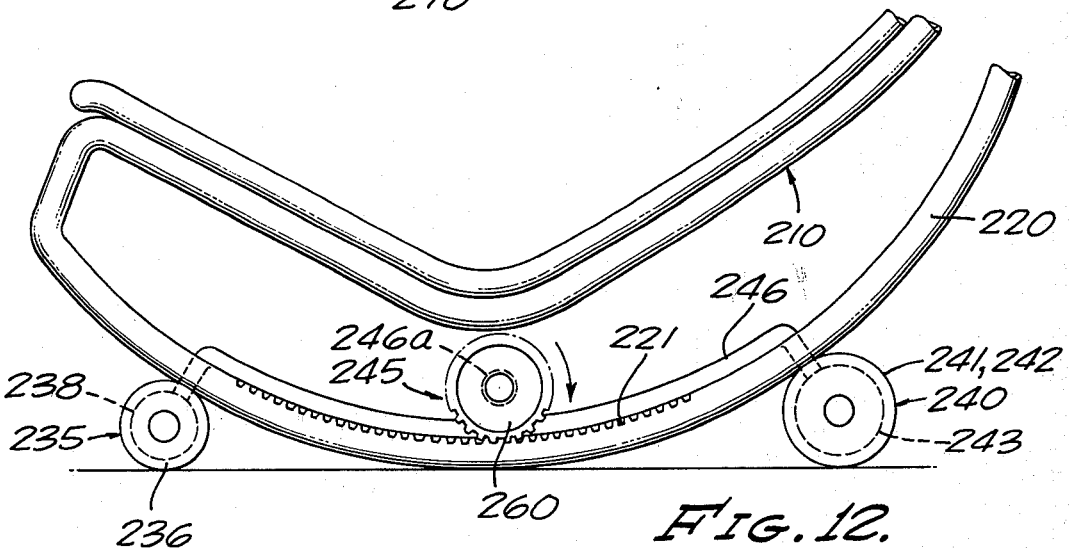
FIG. 12 is a side view like FIG. 9 but showing the chair in a different position.

As shown in FIG. 12, when the upper surface of hand wheel 270 is moved rearwardly, the entire restraint mechanism is driven rearwardly relative to the rockers, and the chair inclines back more sharply than before. The weight of a person sitting in the chair shifts rearwardly and is divided between the rockers 220 and rear chuck 243. In this position of the chair, front chuck 238 performs no particular function and could be omitted.

THIRD EMBODIMENT

Reference is now made to FIGS. 13 through 15, inclusive, illustrating a third embodiment of the invention.

Chair frame 310 includes and is supported from rocker members 320. A front chuck 235 includes a pair of wheels rotatably supported on the ends of an axle. The wheels rest upon the floor 100 and also engage the undersurface of rocker members 320. A rear chuck 340 is constructed in the same manner.

As shown in FIG. 15 the front axle is designated as numeral 338 while the rear axle is designated as 343. Restraint frame 345 includes a pair of concavely curved toothed racks 346, 347. Each of these toothed racks fits longitudinally on top of one of the rocker members 320, so as to slide longitudinally therealong. Completing the restraint mechanism is a set of four corner pieces 348 which connect the ends of the toothed racks to the axles 338, 343.

Hand wheel 370 is attached to one end of a shaft 371. Shaft 371 is rotatably supported from the chair frame 310 by means of a pair of holding brackets 311, 312. The ends of shaft 371 carry a pair of drive gears 360, 361. Drive gear 360 engages the toothed rack 346 while drive gear 361 engages the toothed rack 347.

Thus, the rotation of the upper surface of hand wheel 370 is a forwardly direction causes the restraint frame 345 to move rearwardly, and the chair to recline back further than before. Conversely, movement of the upper surface of the hand wheel in a rearwardly direction causes the restraint frame to move forwardly and the chair to move toward a more upright position.

As in the second and third embodiments, the weight load is divided between the rocker members and the restraint frame. When the chair is tilted sharply in one direction the chuck at the other end performs no useful function.

ALTERNATE FORMS

Although simple gear drive arrangements have been shown herein it will be understood that it may be preferred to utilize a gear reduction mechanism similar to that of FIG. 6 in order to provide increased mechanical advantage for the hand of the operator.

In the second embodiment (FIG. 8) and also in the third embodiment (FIG. 13) the restraint mechanism includes wheels which engage both the floor surface and the under surface of the rocker members. If the wheel rotates on the floor surface then it must slide on the rocker member, or vice versa. While such an arrangement might not be satisfactory for a moving vehicle it is quite adequate for the restraint mechanism of the present invention. The undersides of the rocker members may, for example, be provided with a slick metal surface so that the wheels will easily slide on them. Alternatively, a non-rotating member may be utilized in place of a wheel.

It should be pointed out that wherever in this description a reference is made to a rocker or a rocker member, this reference is equally intended to mean a rocker-shaped member.

While the present invention has been disclosed in detail in at least one of its forms in order to comply with the Patent laws, it will nevertheless be understood that the breadth and scope of the invention are defined only in accordance with the following claims.

What is claimed is:

1. An adjustable reclining chair comprising:

a seat and back supporting frame having a parallel pair of curved rocker members depending downwardly therefrom and adapted to engage a floor surface on a selected longitudinal portion of their length;

a restraint mechanism including a front chuck disposed in front of the floor-engaging portion of said rocker members and a rear chuck disposed to the rear thereof, said front and rear chucks engaging the floor surface, said restraint mechanism being mounted as a unit, relative to said rocker members, for movement relative to said frame along a curved pathway parallel to said curved rocker members either forwardly or rearwardly relative to and along said rocker members; and drive means interconnecting said frame and said restraint mechanism for selectively moving said restraint mechanism relative to said frame so that said restraint mechanism moves along the floor and changes the tilt of said rocker members and hence the angle at which said frame reclines.

2. A chair as in claim 1 said restraint mechanism includes a carriage to which said front and rear chucks are attached.

3. A chair as in claim 1 wherein each of said front and rear chucks includes a pair of wheels for engaging the floor surface.

4. A chair as in claim 1 which further includes means for manually operating said drive means.

5. A chair as in claim 4 wherein said restraint mechanism extends upwardly adjacent the under surfaces of said frame, and wherein said drive mechanism includes a curved toothed rack parallel to said rocker members attached to one of said frame and restraint mechanism and a pinion gear rotatably mounted on the other of said restraint mechanism and frame and meshing with said rack.

6. A chair as in claim 2 wherein said drive means includes a curved toothed rack attached to said frame and a pinion gear mounted on said restraint carriage.

7. A chair as in claim 5 wherein said curved toothed rack is attached to said frame and said pinion gear is attached to said restraint mechanism.

8. A chair as in claim 5 wherein said curved toothed rack is attached to said restraint mechanism and said pinion gear is attached to said frame.

9. A chair as in claim 7 wherein said toothed rack is attached to said frame directly above one of said rocker members and is concavely curved.

10. A chair as in claim 7 wherein said toothed rack is attached to said frame a substantial distance above said rocker members and is convexly curved.

11. A chair as in claim 8 wherein said curved toothed rack is concavely curved.

12. A chair as in claim 5 wherein said curved toothed rack is located below said pinion gear and concavely curved.

13. A chair as in claim 5 wherein said curved toothed rack is located above said pinion gear and is convexly curved.

14. A chair as in claim 5 wherein said drive means further includes gear reduction means cooperable with said pinion gear, whereby the movement of said pinion gear relative to said curved toothed rack is less than the corresponding movement of the manual operating means.

15. A chair as in claim 5 wherein said drive means further includes gear reduction means cooperable with said pinion gear, whereby said drive means tends to lock said frame at a selected angle of inclination relative to the floor surface.

16. An adjustable reclining chair comprising:

a chair frame including a parallel pair of curved rocker members together with a seat and a back supported thereon, said rocker members being adapted to engage a floor surface on a selected longitudinal portion of their length corresponding to a selected angle of inclination of said chair frame;

a restraint mechanism including a front chuck engaging the floor surface in front of the floor-engaging portion of said rocker members and a rear chuck engaging the floor surface to the rear thereof, said restraint mechanism being adapted for selective movement as a unit along a floor surface in either a forwardly or a rearwardly direction relative to said rocker members; and drive means interconnecting said frame with said restraint mechanism and operable for selectively moving said restraint mechanism relative to said frame along a curved path parallel to the curved lower surfaces of said rocker members to thereby cause said restraint mechanism to move along the floor surface while concurrently changing the angle of inclination of said chair frame relative to the floor surface.

17. The chair of claim 16 wherein said drive means includes a curved toothed rack and a pinion gear meshing therewith, one being attached to said frame and the other being attached to said restraint mechanism, and gear reduction means cooperable with said pinion gear.

18. An adjustable reclining chair comprising:

a chair frame including a parallel pair of rocker members each curved to form substantially an arc of a circle, together with a seat and a back supported on said rocker members, said rocker members engaging a floor surface upon which said reclining chair is supported;

a restraint mechanism including a front chuck, a rear chuck, and a carriage to which said chucks are attached, said chucks engaging the floor surface respectively in front of, and behind, the floor-engaging portion of said rocker members;

gear means interconnecting said restraint mechanism with said chair frame, including a curved toothed rack disposed substantially concentric to said rocker members and a pinion gear meshing with said rack, said rack being attached to one of said carriage and said frame and said pinion gear being attached to the other thereof; and manually operated gear reduction drive means coupled to said pinion gear for selectively rotating said restraint mechanism relative to said chair frame about the centers of said circles, thereby causing said front and rear chucks to move relative to said rocker members along a curved path which is parallel to said rocker members, but at the same time along a straight pathway parallel to the floor surface;

said rocker members then having a different portion thereof engaging the floor surface and said chair frame being then confined by said restraint mechanism to a newly selected angle of inclination relative to the floor surface.

19. The chair of claim 18 wherein each of said front and rear chucks has wheels which roll along the floor surface whenever the angle of inclination of said chair frame is changed.

20. The chair of claim 18 wherein said curved toothed rack is located below said pinion gear and is concavely curved.

21. The chair of claim 18 wherein said curved toothed rack is located above said pinion gear and is convexly curved.

22. An adjustable reclining chair comprising:

a chair frame including a parallel pair of curved rocker members together with a seat and a back supported thereon, said rocker members being adapted to engage a floor surface on a selected longitudinal portion of their length corresponding to a selected angle of inclination of said chair frame;

a restraint mechanism including a front chuck engaging the floor surface in front of the floor-engaging portion of said rocker members and a rear chuck engaging the floor surface to the rear thereof, said restraint mechanism being adapted for selective movement as a unit along the floor surface in either a forwardly or a rearwardly direction relative to said rocker members; and drive means interconnecting said frame with said restraint mechanism and operable for selectively moving said restraint mechanism relative to said frame along a curved path parallel to the curved lower surfaces of said rocker members to thereby cause said restraint mechanism to move along the floor surface while concurrently changing the angle of inclination of said chair frame relative to the floor surface;

said drive means including a curved toothed rack and a pinion gear meshing therewith, one being attached to said frame and the other being attached to said restraint mechanism.

23. A chair as in claim 22 wherein said curved toothed rack is attached to said frame and said pinion gear is attached to said restraint mechanism.

24. A chair as in claim 22 wherein said curved toothed rack is attached to said restraint mechanism and said pinion gear is attached to said frame.

25. A chair as in claim 23 wherein said toothed rack is attached to said frame directly above one of said rocker members and is concavely curved.

26. A chair as in claim 23 wherein said toothed rack is attached to said frame a substantial distance above said rocker members and is convexly curved.

27. A chair as in claim 24 wherein said curved toothed rack is concavely curved.

28. A chair as in claim 22 wherein said curved toothed rack is located below said pinion gear and is concavely curved.

29. A chair as in claim 22 wherein said curved toothed rack is located above said pinion gear and is convexly curved.

30. A chair as in claim 22 wherein said drive means further includes gear reduction means cooperable with said pinion gear, whereby the movement of said pinion gear relative to said curved toothed rack is less than the corresponding movement of the manual operating means.

31. A chair as in claim 22 wherein said drive means further includes gear reduction means cooperable with said pinion gear, whereby said drive means tends to lock said frame at a selected angle of inclination relative to the floor surface.

32. A chair as in claim 22 wherein said chucks include rollers engaging the floor surface.

33. A chair as in claim 1 wherein each of said chucks extends underneath, and physically blocks the movement of, the associated portions of said rocker members.

34. A chair as in claim 33 wherein each of said chucks is equipped with a pair of rollers engaging the floor surface.

35. A chair as in claim 34 wherein each of said chucks is equipped with an additional pair of rollers engaging the respective rocker members.

36. A chair as in claim 1 wherein each of said chucks is equipped with a single pair of wheels, each wheel engaging both the floor surface and an associated rocker member.

37. A chair as in claim 16 wherein each of said front and rear chucks has wheels which roll along the floor surface whenever the angle of inclination of said chair frame is changed.

38. The chair of claim 17 wherein said curved toothed rack is located below said pinion gear and is concavely curved.

39. The chair of claim 17 wherein said curved toothed rack is located above said pinion gear and is convexly curved.

40. A chair as in claim 17 wherein said curved toothed rack is attached to said frame and said pinion gear is attached to said restraint mechanism.

41. A chair as in claim 17 wherein said curved toothed rack is attached to said restraint mechanism and said pinion gear is attached to said frame.

42. A chair as in claim 40 wherein said toothed rack is attached to said frame directly above one of said rocker members and is concavely curved.

43. A chair as in claim 40 wherein said toothed rack is attached to said frame a substantial distance above said rocker members and is convexly curved.

44. A chair as in claim 16 wherein each of said chucks extends underneath, and physically blocks the movement of, the associated portions of said rocker members.

45. A chair as in claim 44 wherein each of said chucks is equipped with a pair of rollers engaging the floor surface.

46. A chair as in claim 45 wherein each of said chucks is equipped with an additional pair of rollers engaging the respective rocker members.

47. An adjustable reclining chair comprising:

a chair frame including a parallel pair of curved rocker-shaped members together with a seat and a back supported thereon, said rocker-shaped members being adapted to engage a floor surface on a selected longitudinal portion of their length corresponding to a selected angle of inclination of said chair frame;

a restraint frame movably secured to said chair frame and having a rear chuck adapted to engage the floor surface to the rear of the floor-engaging portion of said rocker-shaped members, said restraint frame being mounted upon said chair frame for movement of said rear chuck along a curved pathway parallel to said curved rocker-shaped members either forwardly or rearwardly relative to and along said rocker-shaped members;

drive means interconnecting said chair frame with said restraint frame and operable for selectively driving said restraint frame in a turning movement relative to said chair frame, said turning movement causing said rear chuck to move along the floor surface longitudinally of said rocker-shaped members and concurrently causing said chair frame to change its angle of inclination relative to the floor surface; and said drive means including a curved toothed rack and a pinion gear meshing therewith, one being attached to said chair frame and the other being attached to said restraint frame, and manually operated gear reduction drive means coupled to said pinion gear.

48. The chair of claim 47 wherein said curved toothed rack is attached to said chair frame.

49. An adjustable reclining chair comprising:

a chair frame having a seat and a back, and a pair of curved rocker-shaped members adapted to engage a floor surface;

a restraint frame movable secured to said chair frame and having a part thereof adapted to engage the floor surface at a location longitudinally displaced from the engagement thereof by the rocker-shaped members, said restraint frame operating to inhibit a rocking movement of said chair frame and to restrain same to a selected angle of inclination relative to the floor surface; and drive means coupled between said restraint frame and said chair frame and operable for selectively turning said restraint frame relative to said chair frame so that the floor engaging part of said restraint frame moves along a curved pathway that is parallel to said curved rocker-shaped members and at the same time along the floor surface longitudinally of said rocker-shaped members and concurrently causes said chair frame to change its angle of inclination.

50. A reclining chair as in claim 49 wherein said drive means includes a curved toothed rack and a pinion gear meshing therewith, one being attached to said chair frame and the other being attached to said restraint frame; and manually operated gear reduction drive means coupled to said pinion gear.

51. The chair of claim 50 wherein said curved toothed rack is attached to said chair frame.

52. A method of using a rocking chair, having a chair frame with curved rockers, as an adjustable reclining chair, comprising the steps of:

selecting a restraint frame;

securing one part of the restraint frame to the chair frame so that another part of the restraint frame engages the floor surface at a location longitudinally displaced from the engagement thereof by the rockers;

placing a weight load on the chair frame in such a position that the weight thereof is divided between the rockers and the restraint frame; and turning the restraint frame relative to the chair frame so as to drivingly move said other part of said restraint frame along a curved pathway parallel to said curved rockers and at the same time along the floor surface, thereby changing the angle at which the chair frame reclines.

* * * * *